US006763663B2

(12) United States Patent
Mansour et al.

(10) Patent No.: US 6,763,663 B2
(45) Date of Patent: Jul. 20, 2004

(54) INJECTOR WITH ACTIVE COOLING

(75) Inventors: Adel B. Mansour, Mentor, OH (US); Rex J. Harvey, Mentor, OH (US); Michael A. Benjamin, Shaker Heights, OH (US); Peter V. Buca, Parma Heights, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 10/120,288

(22) Filed: Apr. 10, 2002

(65) Prior Publication Data

US 2003/0010033 A1 Jan. 16, 2003

Related U.S. Application Data

(60) Provisional application No. 60/304,689, filed on Jul. 11, 2001.

(51) Int. Cl.[7] ..... F02C 1/00; F02G 3/00

(52) U.S. Cl. ..... 60/740; 60/742; 60/39.83; 60/746

(58) Field of Search ..... 60/740, 742, 746, 60/39.83

(56) References Cited

U.S. PATENT DOCUMENTS

| | | | | | |
|---|---|---|---|---|---|
| 2,206,070 A | | 7/1940 | Andler | 158/76 |
| 3,565,346 A | | 2/1971 | Carrell | 239/422 |
| 3,608,833 A | | 9/1971 | Hankins | 239/553.3 |
| 3,612,397 A | | 10/1971 | Pearson | 239/127.1 |
| 3,615,054 A | | 10/1971 | Botz | 239/553.3 |
| 3,710,574 A | * | 1/1973 | Pearson | 60/258 |
| 4,004,416 A | | 1/1977 | Amelio et al. | 60/264 |
| 5,351,489 A | * | 10/1994 | Okamoto et al. | 60/740 |
| 5,740,967 A | | 4/1998 | Simmons et al. | 239/494 |
| 5,916,142 A | * | 6/1999 | Snyder et al. | 60/748 |
| 5,966,937 A | * | 10/1999 | Graves | 60/748 |
| 6,460,340 B1 | * | 10/2002 | Chauvette et al. | 60/740 |

* cited by examiner

*Primary Examiner*—Justine R. Yu
*Assistant Examiner*—William H. Rodriguez
(74) *Attorney, Agent, or Firm*—Christopher H. Hunter

(57) ABSTRACT

An injector includes a plurality of flat, circular plates which provide fuel delivery and cooling of the injector. Fuel delivery passages in the plates have swirl chambers and spray orifices which are formed by chemical etching. A pair of fuel delivery plates define a fuel cavity therebetween, and include a plurality of radially-outwardly extending spokes, with the spokes from one fuel plate in adjacent, surface-to-surface relation with opposing spokes from the adjacent fuel plate. A fuel passage is defined between each of the opposing spokes, leading from the fuel cavity to a fuel outlet opening at the distal end of each spoke. A fuel tube delivers fuel to the fuel cavity between the plates, from where the fuel is then directed through the outlet openings. Downstream plates shape the fuel into appropriate sprays for ignition. An upstream cooling plate assembly directs air against the upstream fuel plate, and radially outwardly along the spokes of the upstream plate. The air is delivered through an air tube, concentric with the fuel delivery tube.

13 Claims, 11 Drawing Sheets

INJECTOR WITH ACTIVE COOLING

CROSS-REFERENCE TO RELATED CASES

The present application claims the benefit of the filing date of U.S. Provisional Application Serial No. 60/304,689; filed Jul. 11, 2001.

BACKGROUND OF THE INVENTION

The present invention relates to fluid delivery systems, and more particularly relates to injectors and nozzles therefore, useful for dispensing liquid fuel in gas turbine engine applications.

The nozzle in a fluid delivery system is an important component of the system. In aircraft applications, for example, where fuel is delivered through the nozzle for combustion in a combustor, it is desirable to reduce emissions, provide better spray patternization and provide more uniform combustion of fuel.

One such nozzle is illustrated and described in U.S. Pat. No. 5,740,967, which is owned by the assignee of the present invention. In this nozzle, liquid fuel enters a swirl chamber, where it is caused to move in a vortex toward the center of the chamber, and then exit the chamber and be delivered through a spray orifice, forming a hollow cone spray. The swirl chamber and orifice are formed by chemical etching one or more plates. The etching produces a nozzle with very streamlined geometries resulting in reductions in pressure losses and enhanced spray performance. The chemical etching process is easily repeatable and highly accurate, and can produce multiple nozzles on a single plate for individual or simultaneous use.

One embodiment of this type of nozzle is shown in U.S. patent application Ser. No. 09/794,490, for "Integrated Fluid Injection and Mixing System", filed Feb. 27, 2001, which is also owned by the assignee of the present invention. In this embodiment, the nozzles are located in an injector, and air passages are provided through the plates in surrounding relation to the nozzles. The air passages direct air radially inward in a swirling manner around the fuel sprays to provide a homogeneous fuel-air mixture. It has been found that this injector is particularly useful in reducing Nitrogen Oxide (Nox) and Carbon Monoxide (CO) emissions, and the spray is well dispersed for efficient combustion.

The power generation industry is faced with increasingly stringent emissions requirements for ozone precursors, such as nitrogen oxides and carbon monoxide. To achieve lower pollutant emissions, gas turbine manufacturers have adopted lean premixed (LP) and lean direct injection (LDI) combustion as a standard. LP combustion achieves low levels of pollutant emissions without additional hardware for steam injection or selective catalytic reduction (SCR). By premixing the fuel and air, localized regions of near stoichiometric fuel-air mixtures are avoided, and a subsequent reduction in thermal NOx can be realized. To achieve lower levels of NOx emissions, homogeneous fuel-air mixture distributions are necessary. To achieve mixture homogeneity, a spatially resolved, multipoint fuel injection strategy is often required. Relative to single-point fuel injection, multi-point fuel injection offers numerous advantages, such as significantly shorter mixing length and time scales. These shorter mixing scales can result in shorter premixer lengths and a significantly lower propensity for flashback and autoignition.

Another factor is cooling. When the fuel is ignited, the engine temperature increases, which can lead to coking of surfaces and the interruption of fuel flow. Cooling passages and heat shields can be provided, however this can add to the size and weight of an engine, and generally make it more difficult to manufacture (and repair) the engine.

As such, it is believed that there is a further demand for an improved injector with a multiple spray nozzle arrangement which combines many of the advantages of the above nozzles, but which has a more compact form and good thermal management. While these issues are primarily important in fuel injectors for gas turbine engines, it is believed that the same issues arise in other liquid fuel applications as well, such as in industrial power applications, as well as generally in other fluid applications.

SUMMARY OF THE PRESENT INVENTION

The present invention provides a novel and unique injector for dispensing fluid, and in particular, an injector for dispensing liquid fuel in gas turbine applications. The injector has multiple nozzles for improved fuel delivery, but has a compact form, which reduces the weight and size of the engine, and good thermal management. The injector preferably has passages which are formed by chemical etching, for efficient fuel flow. The present invention is directed towards achieving fuel-air mixture homogeneity by using an easy and affordable multipoint injection strategy. The nozzle is actively cooled, which provides good atomization performance, fast droplet dispersion, and a mixture homogeneity that it is believed is not readily attainable with conventional nozzle technology.

According to a preferred embodiment of the present invention, the injector includes a plurality of flat, circular plates which are stacked and bonded together in surface-to-surface adjacent relation. The plates have multiple internal passages to provide fuel delivery and cooling of the injector, and cooling of the nozzles. The fuel delivery passages are preferably formed by chemical etching for efficient fuel flow through the injector. At least some of the cooling passages are also formed by etching.

A pair of fuel delivery plates are arranged in adjacent, surface-to-surface relation with each other, and define a fuel cavity therebetween. The upstream fuel plate includes an opening along the central axis to receive an elongated fuel tube. Both plates also include a plurality of spokes, which extend radially outward from the central axis, in evenly, spaced-apart relation to one another, with the spokes from one plate in adjacent, surface-to-surface relation with the opposing spokes from the adjacent plate. A fuel passage is provided between each of the opposing spokes, leading radially from the fuel cavity to a fuel delivery opening at the distal end of each spoke. The fuel delivery openings are oriented to deliver the fuel axially from the spokes. The fuel tube delivers fuel to the fuel cavity between the plates, where the fuel is directed outwardly along the individual passages to the delivery openings. Downstream plates are provided to shape the fuel into appropriate sprays for ignition. Preferably, the downstream plates also have passages formed by chemical etching, which define multiple simplex nozzles around the injector and shape the fuel streams into hollow conical sprays. The sprays combine in a homogeneous mixture for reduced emissions, good patternization, and improved combustion.

To cool the fuel delivery passages during engine operation, an upstream cooling plate assembly is provided. The cooling plate assembly includes a stack of plates that direct air against the upstream surface of the upstream fuel delivery plate, and radially outwardly along the spokes of the upstream plate. The cooling air then passes downstream around each of the hollow core sprays. The air preferably is delivered through an air tube, which runs concentric with and outwardly surrounds the fuel delivery tube. The air tube also cools and thermally protects the fuel passing through the fuel tube.

Thus, as described above, the present invention provides an injector, particularly useful for dispensing liquid fuel in gas turbine applications, which is an improvement on the previous designs. The injector has multiple nozzles for improved fuel delivery, and has a compact form, which reduces the size and weight of the engine, and good thermal management. The injector preferably has passages which are formed by chemical etching, for efficient fluid flow through the injector. The actively cooling nozzle provides good atomization performance, fast droplet dispersion and good fuel-air mixture homogeneity.

Further features of the present invention will become apparent to those skilled in the art upon reviewing the following specification and attached drawings.

DETAILED DESCRIPTION OF THE PREFERRED EMBODIMENT

Figure 1:
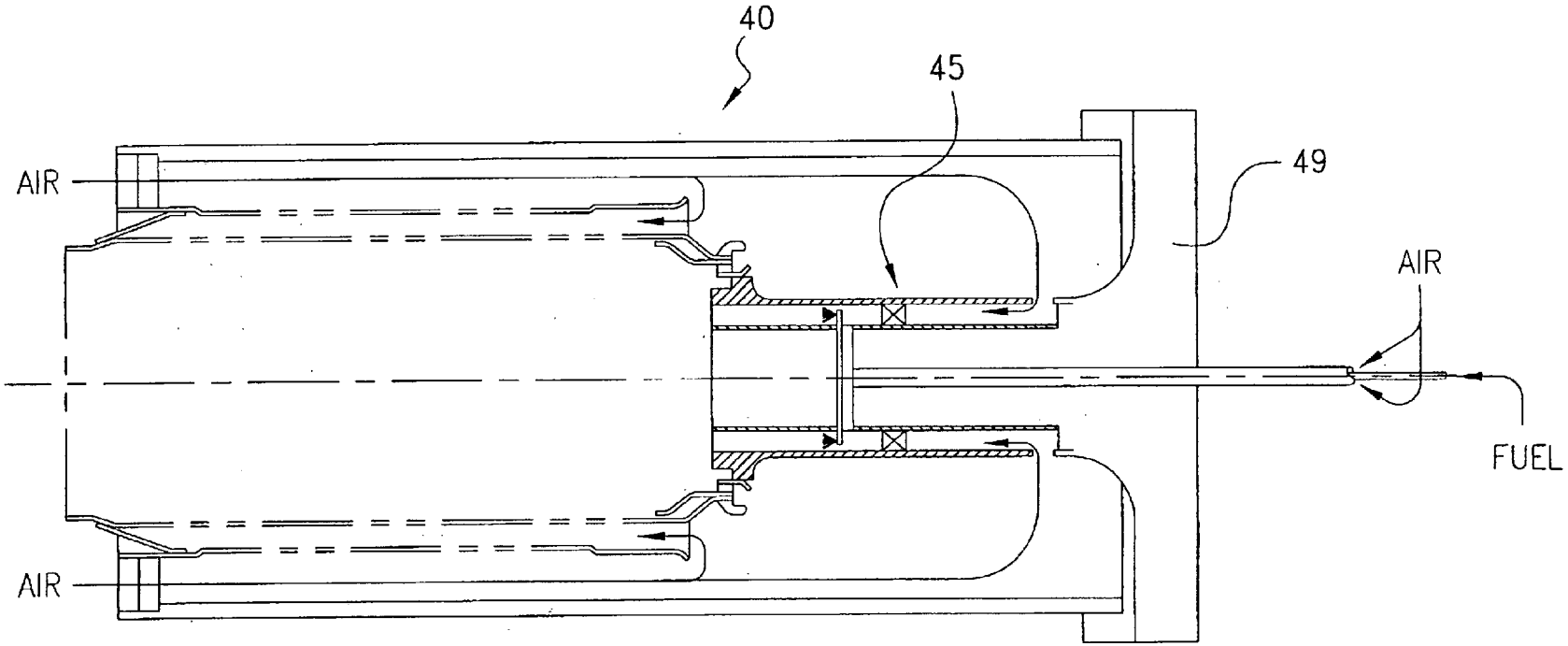
FIG. 1 is an elevated perspective view of a portion of a gas turbine engine, showing an injector constructed according to the principles of the present invention mounted for dispensing fuel.

Referring to the drawings, and initially to FIG. 1, a premixer in a gas turbine engine is indicated generally at 40, and includes one or more injectors, such as indicated generally at 45, mounted internally of the premixer, and constructed in accordance with the principles of the present invention. The injector 45 includes a plurality of nozzles for dispensing fuel, as will be described more fully below, and is particularly useful for dispensing liquid fuel in gas turbine engines, however the injectors are useful in other combustion applications, such as in liquid hydrocarbon burners, where a fine dispersion of fuel droplets of two fluids (e.g., a liquid fuel and air) is desirable. While the terms "fuel" and "air" are used to describe two fluids useful in the preferred embodiment of the present invention, it should be appreciated that these fluids are only examples of the fluids that can be directed through the injector, and that the present invention is applicable to a wide variety of fluids for many different applications, including, but not limited to, dual-fuel injectors.

Figure 2:
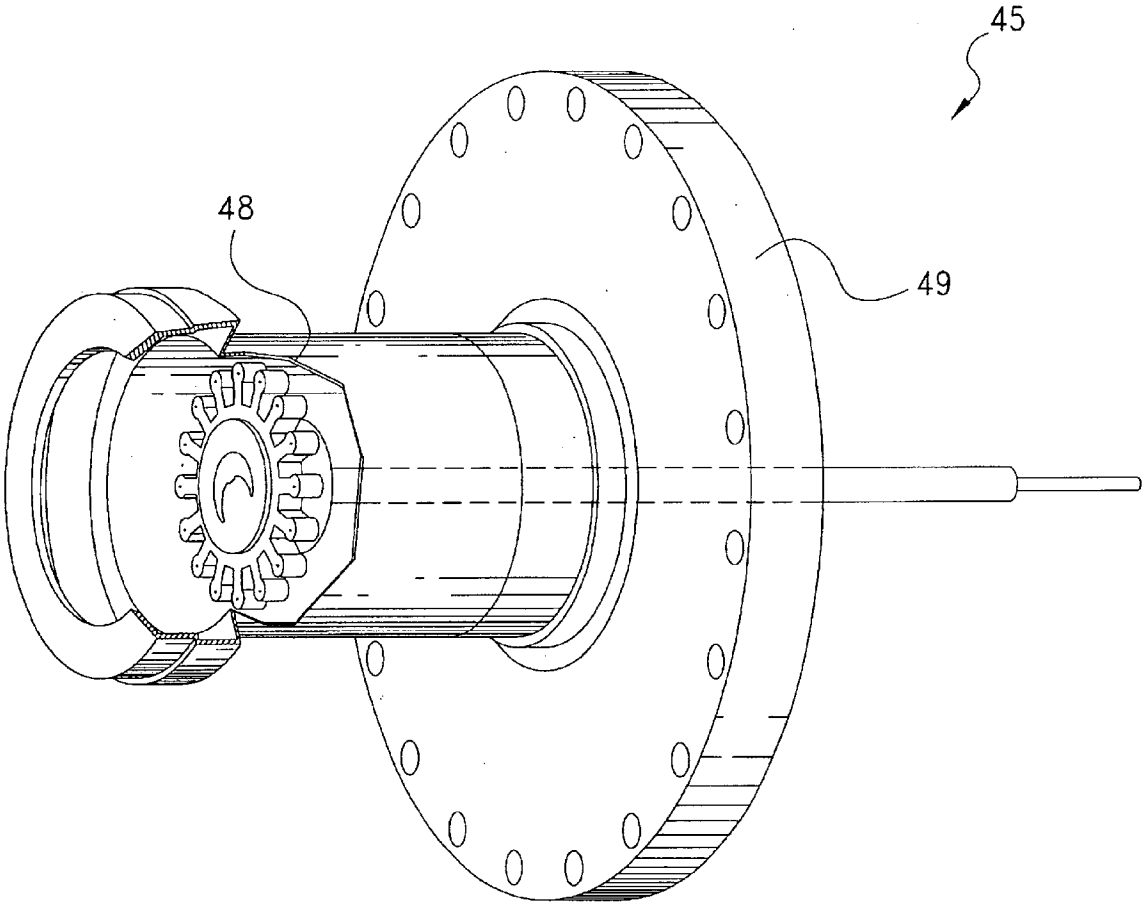
FIG. 2 is a perspective view of the injector of FIG. 1.

Referring also to FIG. 2, the injector 45 preferably includes a cylindrical injector housing 48 mounted to a circular base 49. The housing 48 and base 49 provide appropriate passages for directing air through the premixer for ignition. The premixer 40, including housing 48 and base 49, is only one example of an application for the injector of the present invention, and these components are shown for illustration purposes only.

Figure 4:
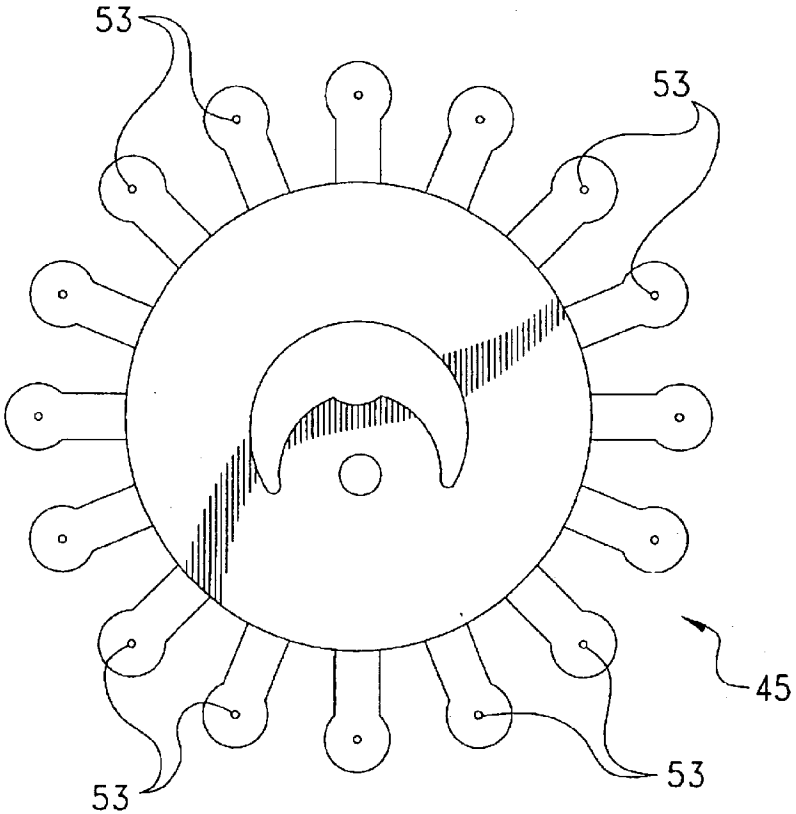
FIG. 4 is a downstream end view of the injector.
Figure 3:
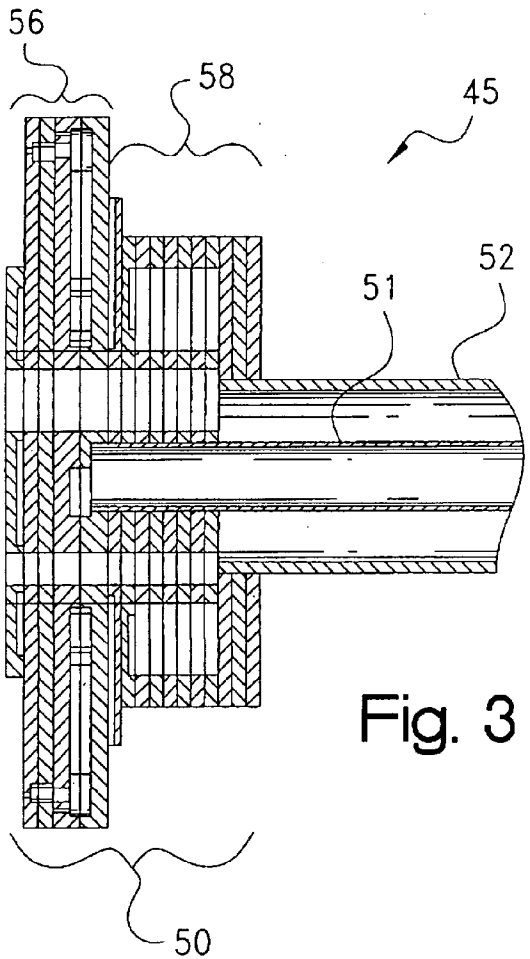
FIG. 3 is a cross-sectional side view of the injector of FIG. 2.

Referring now to FIGS. 3 and 4, the internal components of the injector are shown. The injector includes a series of plates, indicated generally at 50, which define fuel and air passages through the injector. A fuel tube 51 and a concentric air tube 52, outwardly surrounding the fuel tube deliver air and fuel to the plate stack. The fuel is delivered in conical, thin film sprays through a series of nozzles, such as indicated at 53, at the downstream end of the injector. The sprays combine in the premixer, and are ignited downstream of the injector.

Figure 5:
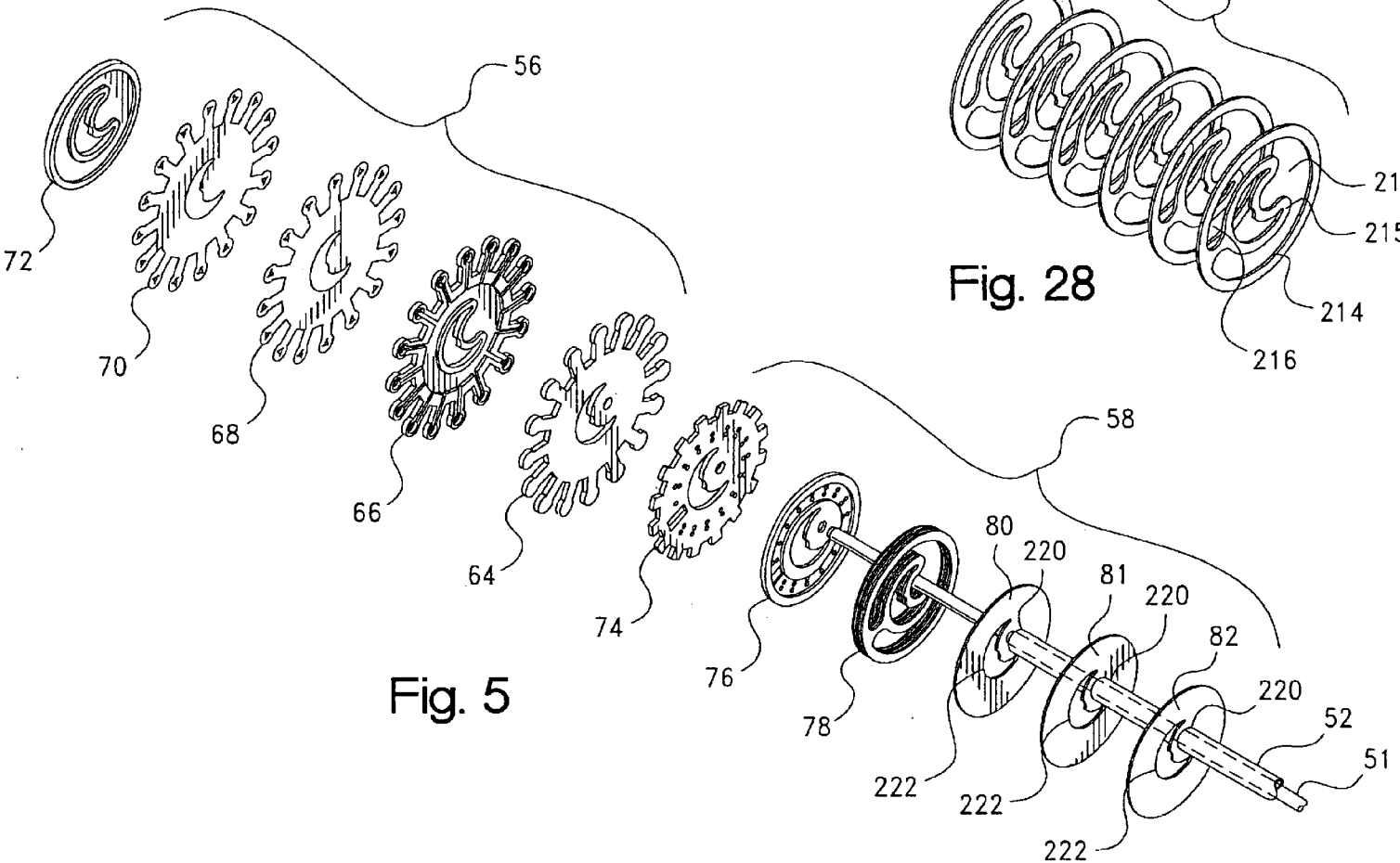
FIG. 5 is an exploded view of the injector.

Referring now also to FIG. 5, the plate stack of the injector includes a fuel plate assembly 56, and a cooling plate assembly 58. The fuel plate assembly directs fuel received from fuel tube 51 to nozzles 53; while the cooling plate assembly 58 directs cooling air against certain parts of the fuel plate assembly to provide thermal management of the fuel in the injector.

The fuel plate assembly 56 includes a manifold plate 64; a distribution plate 66, located in adjacent, surface-to-surface relation with the manifold plate 64, and downstream thereof; a spin plate 68, located in adjacent, surface-to-surface relation with the distribution plate 66, and downstream thereof; a spin-orifice plate 70 located in adjacent, surface-to-surface relation with the spin plate 68, and downstream thereof; and finally, a heat shield plate 72, located in adjacent, surface-to-surface relation with the spin-orifice plate 70, and downstream thereof.

The cooling plate assembly 58 includes a main air distribution plate 74, located in adjacent, surface-to-surface relation with the manifold plate 64, and upstream thereof; an equalizing plate 76, located in adjacent, surface-to-surface relation with the main air distribution plate 74, and upstream thereof; air distribution plate stack 78, located in adjacent, surface-to-surface relation with the equalizing plate 76, and upstream thereof; and additional air inlet and distribution plates 80, 81 and 82, located in adjacent, surface-to-surface relation with each other and with the plate stack 78, and upstream thereof.

Figure 7:
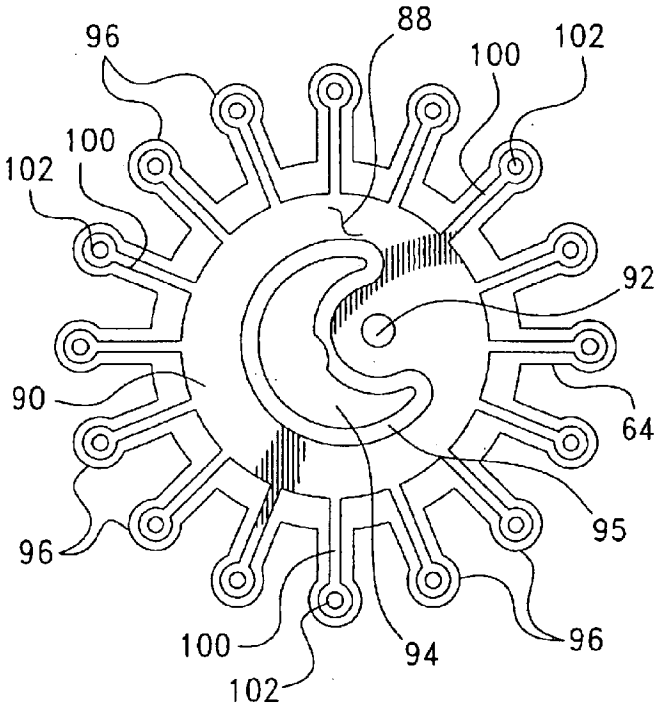
FIG. 7 is a downstream end view of the manifold plate for the injector.
Figure 8:
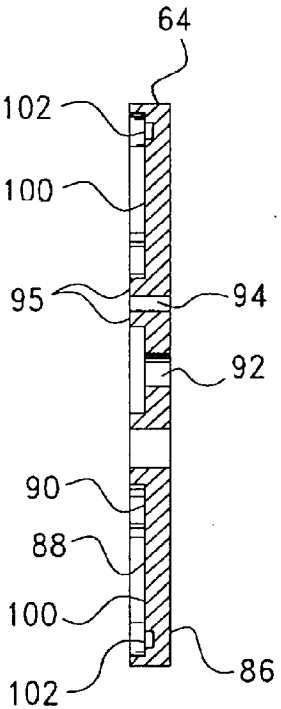
FIG. 8 is a cross-sectional side view of the manifold plate, taken substantially along the plane defined by the lines 8—8 in FIG. 7.
Figure 6:
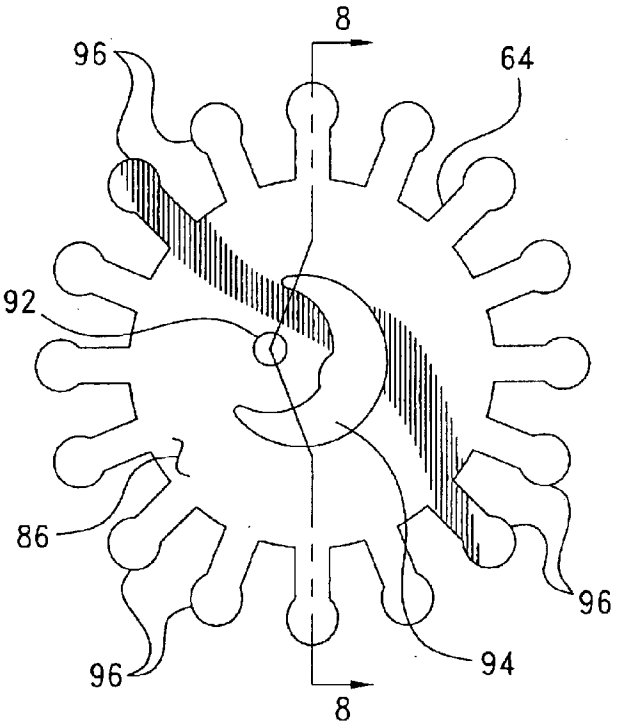
FIG. 6 is an upstream end view of the manifold plate for the injector.

Referring now to FIGS. 6–8, the manifold plate 64 of the fuel plate assembly has a generally circular, thin, flat configuration. The upstream surface 86 (FIG. 6) is generally solid and continuous; while the downstream surface 88 (FIG. 7) has a central recess 90. A circular fuel opening 92 and a crescent-shaped air passage 94 also extend through the plate. The crescent-shaped opening 94 is bounded around its periphery by a raised wall 95, which seals against a similar wall in the adjacent downstream plate 66 so that the air passage is fluidly separated from the recess 90. A plurality of spokes, as at 96, project radially outward from the central axis of the plate, preferably in the plane of the plate. A thin, shallow channel as at 100 is formed in the downstream surface 88 along each spoke, leading from the central recess 90 to an axially-downstream directed circular recess 102 at the distal end of each spoke.

Figure 10:
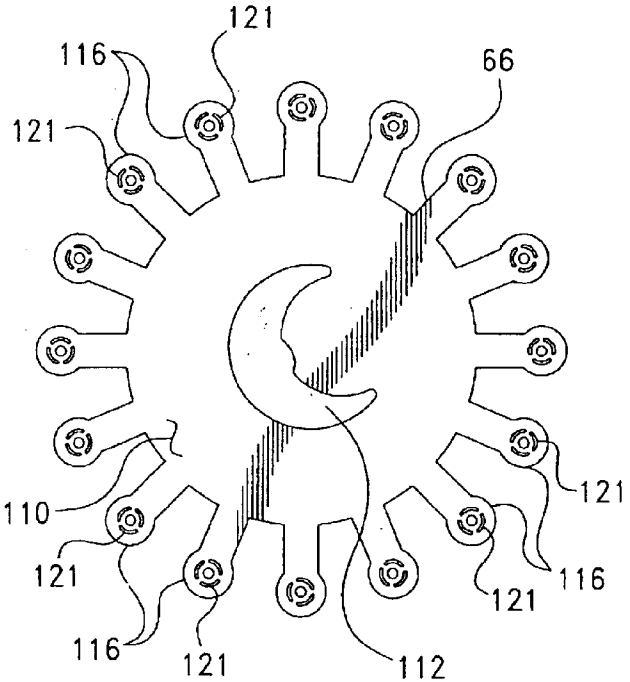
FIG. 10 is a downstream end view of the distributor plate for the injector.
Figure 11:
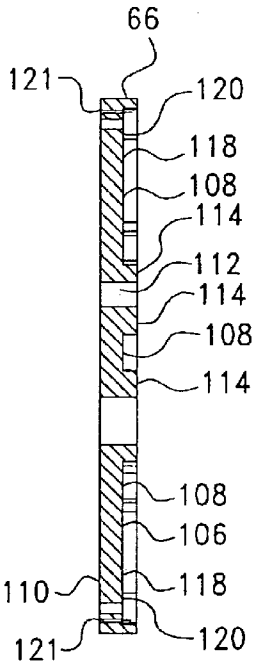
FIG. 11 is a cross-sectional side view of the distributor plate, taken substantially along the plane defined by the lines 11—11 in FIG. 9.
Figure 9:
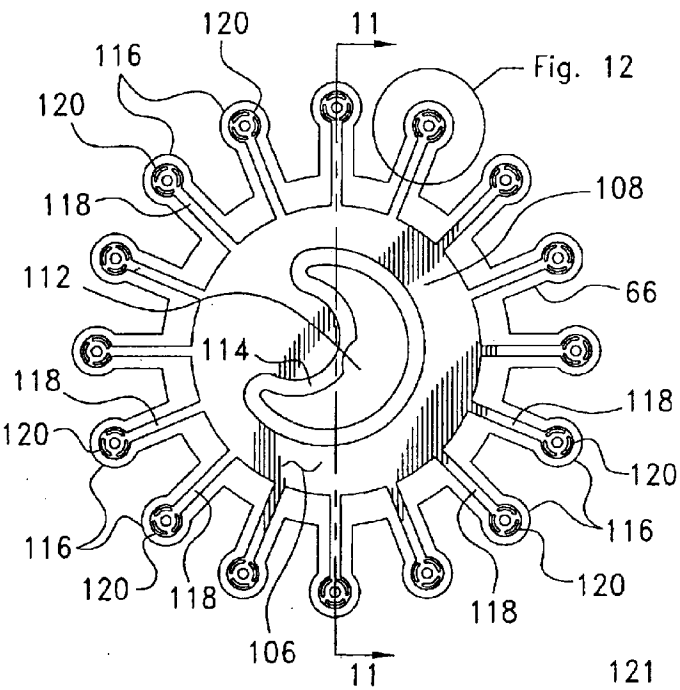
FIG. 9 is an upstream end view of the distributor plate for the injector.
Figure 12:
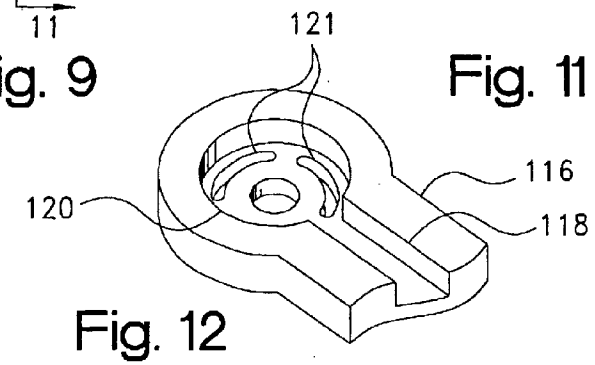
FIG. 12 is an enlarged, elevated perspective view of the distal end of one of the spokes of the distributor plate.

Referring now to FIGS. 9–11, the distribution plate 66 also has a generally circular, thin, flat configuration. The upstream surface 106 (FIG. 9) has a central recess 108 similar to recess 90 in manifold plate 64; while the downstream surface 110 (FIG. 10) is generally solid and continuous. A crescent-shaped air passage 112, similar to air passage 94 in manifold plate 64, also extends through the plate. The crescent-shaped opening 112 is bounded around its periphery by a raised wall 114, which seals against wall 95 in manifold plate 64 so that the air passage is fluidly separated from the recess 106. A plurality of spokes, as at 116, project radially outward from the central axis of the plate, also preferably in the plane of the plate. A thin, shallow channel as at 118 is formed in the upstream surface 106 along each spoke, leading from the central recess 106 to an axially-downstream directed circular distribution recess 120 at the distal end of each spoke. Distribution recess 120 includes one or more through-passages, and preferably includes three equally-spaced, arcuate-shaped passages 121, as shown in FIG. 12.

When the distribution plate 66 is located in adjacent, surface-to-surface relation to manifold plate 64, with the upstream surface 106 of the distribution plate adjacent the downstream surface 88 of the manifold plate, recess 90 in manifold plate 64 and recess 108 in distribution cavity 108 define a fuel cavity. As indicated above, the wall 95 of manifold plate and wall 114 of distribution plate seal together to fluidly separate the air passages from the fuel cavity. The spokes 96 of the manifold plate and the adjacent spokes 116 of the distribution plate are also located in opposing relation, with the channels 100 in the spokes 96, and the channels 118 in the spokes 116, defining individual fuel passages between the spokes.

The distal (outlet) end of fuel tube 51 is received in fuel opening 92 in manifold plate 64, and fixed therein such as by brazing. Fuel delivered through the fuel tube 51 passes through opening 92 and into the fuel cavity. The fuel passages direct fuel from the fuel cavity, radially-outward along the spokes, to the areas bounded by recess 102 in manifold plate 64, and recess 120 in distribution plate 66. The fuel is then directed axially through the arcuate passages 121 in plate 66, in a downstream axial direction.

Figure 14:
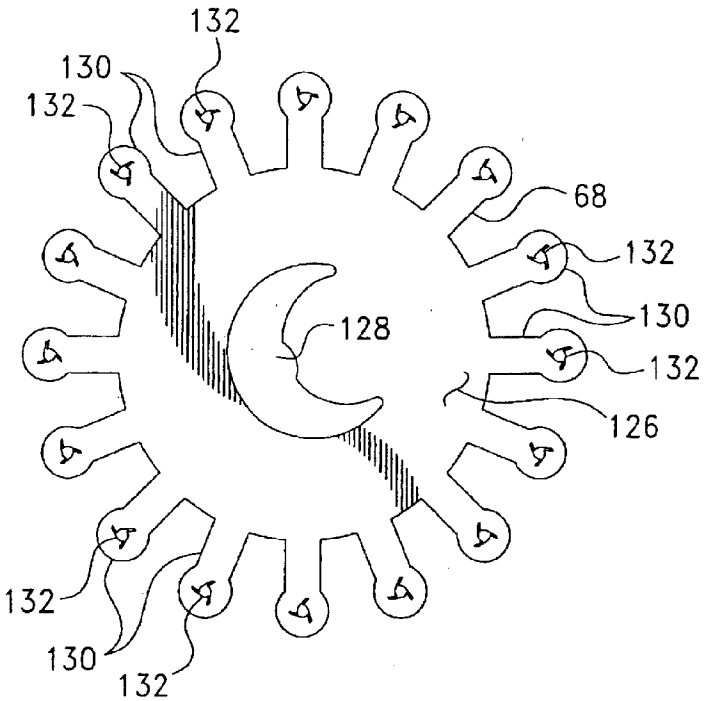
FIG. 14 is a downstream end view of the spin plate for the injector.
Figure 13:
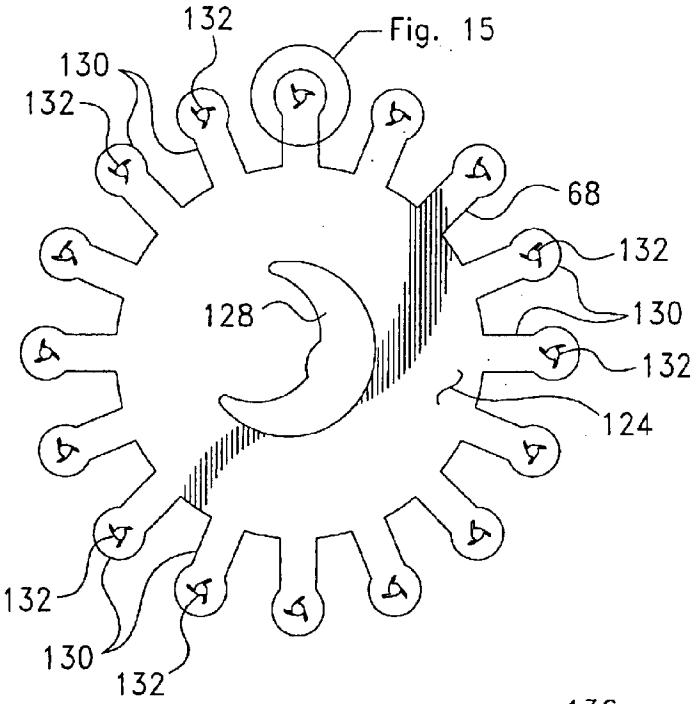
FIG. 13 is an upstream end view of the spin plate for the injector.
Figure 15:
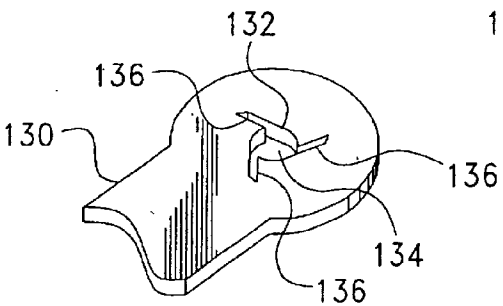
FIG. 15 is an enlarged, elevated perspective view of the distal end of one of the spokes of the spin plate.

Referring now to FIGS. 13 and 14, the spin plate 86 also has a generally circular, thin, flat configuration, with a solid and continuous upstream surface 124 (FIG. 13) and downstream surface 126 (FIG. 14). A crescent-shaped air passage 128, similar to air passage 112 in distribution plate 66, also extends through the plate. A plurality of spokes, as at 130, project radially outward from the central axis of the plate. A fuel distribution opening as at 132 is formed through the plate at the distal end of each spoke. As shown in FIG. 15, the distribution opening 132 includes a central circular swirl chamber portion 134, intersected by non-radial feed passages 136. The radially outer ends of feed passages 136 are generally aligned with the openings 121 in the adjacent distribution plate 66, such that fuel passing through the openings 121 is directed into the ends of the passages 136.

When the spin plate 68 is located in adjacent, surface-to-surface relation to distribution plate 66, with the upstream surface 124 of the spin plate adjacent the downstream surface 110 of the distribution plate, the spokes 130 of the spin plate and the adjacent spokes 116 of the distribution plate are also located in opposing relation, with the openings 121 in the spokes 116 of distribution plate 66 directing fuel into the fuel distribution opening 132 at the distal end of each spoke in spin plate 68.

Figure 17:
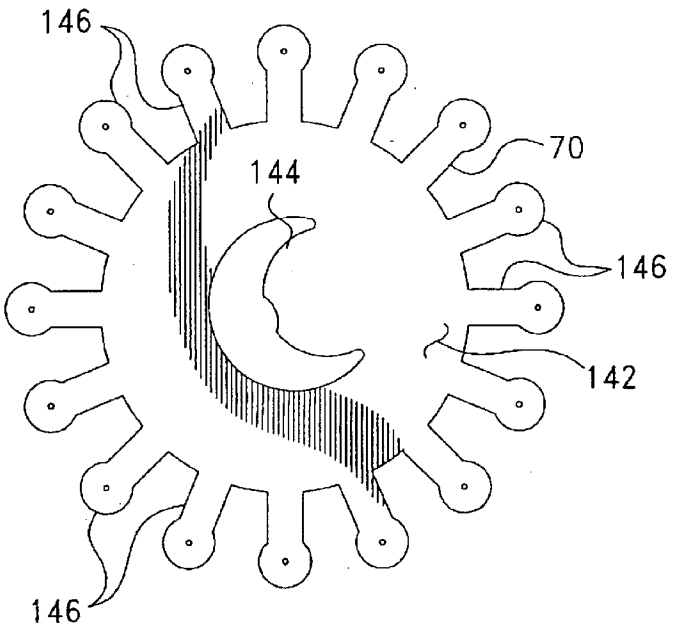
FIG. 17 is a downstream end view of the spin-orifice plate for the injector.
Figure 16:
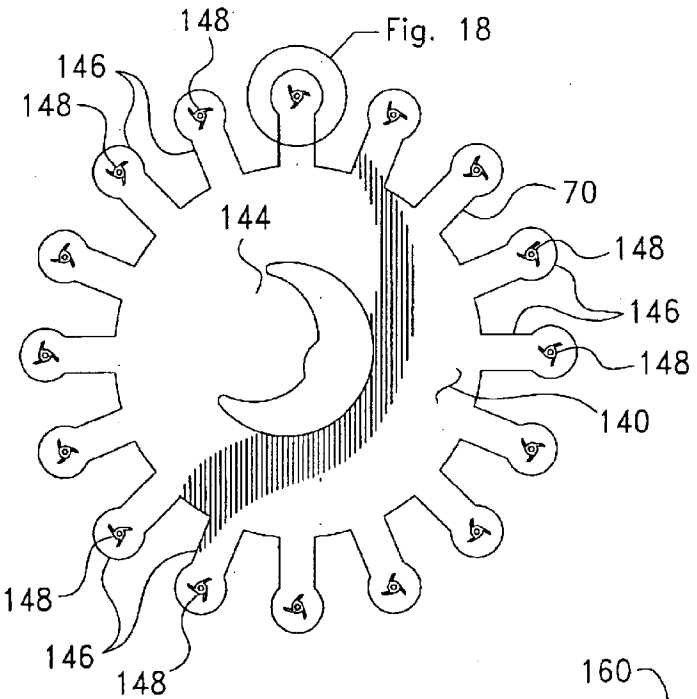
FIG. 16 is an upstream end view of the spin-orifice plate for the injector.
Figure 18:
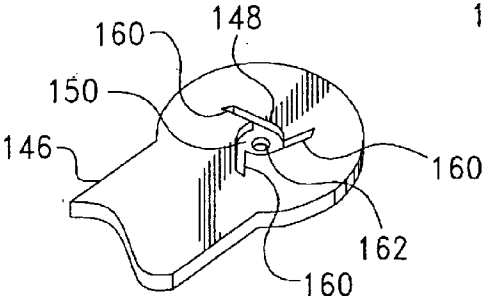
FIG. 18 is an enlarged, elevated perspective view of the distal end of one of the spokes of the spin-orifice plate.

Referring now to FIGS. 16 and 17, the spin orifice plate 70 is similar to the spin plate 88, and also has a generally circular, thin, flat configuration, with a solid and continuous upstream surface 140 (FIG. 16) and downstream surface 142 (FIG. 17). A crescent-shaped air passage 144, similar to air passage 128 in spin plate 68, also extends through the plate. A plurality of spokes, as at 146, project radially outward from the central axis of the plate. A fuel distribution recess as at 148 is formed in the upstream surface 140, at the distal end of each spoke. As shown in FIG. 18, the distribution recess 148 includes a central circular swirl chamber portion 150, intersected by non-radial feed passages 160. A circular fuel outlet 162 is provided centrally in the swirl chamber portion 150.

When the spin orifice plate 70 is located in adjacent, surface-to-surface relation to spin plate 68, with the upstream surface 140 of the spin orifice plate 70 adjacent the downstream surface 126 of the spin plate, the spokes 146 of the spin orifice plate and the adjacent spokes 130 of the spin plate are also located in opposing relation, the passages 136 in spin plate 68 and channels 160 in spin orifice plate 70 are in alignment, and define non-radial fuel passages to direct fuel into a swirl chamber, defined by upstream swirl chamber portion 134 in spin plate 68, and downstream swirl chamber portion 150 in spin orifice plate 70. The fuel then passes inwardly into the swirl chamber in a swirling motion, where the fuel then creates a vortex and passes outwardly through the fuel outlet 162. It should be appreciated by those skilled in the art that the feed passages, swirl chamber and outlet opening define what is commonly referred to as a simplex nozzle.

Figure 20:
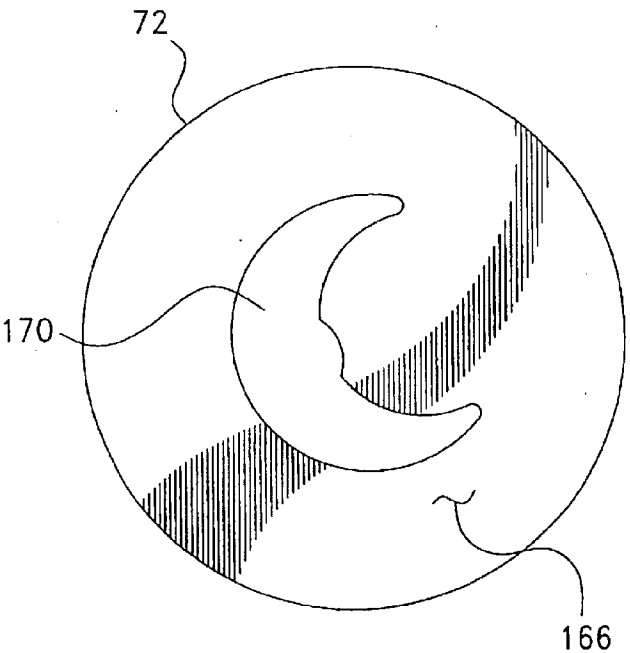
FIG. 20 is a downstream end view of the heat shield plate for the injector.
Figure 21:
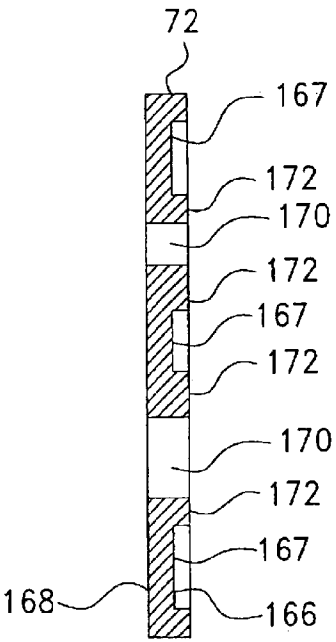
FIG. 21 is a cross-sectional side view of the heat shield plate, taken substantially along the plane defined by the lines 21—21 in FIG. 19.
Figure 19:
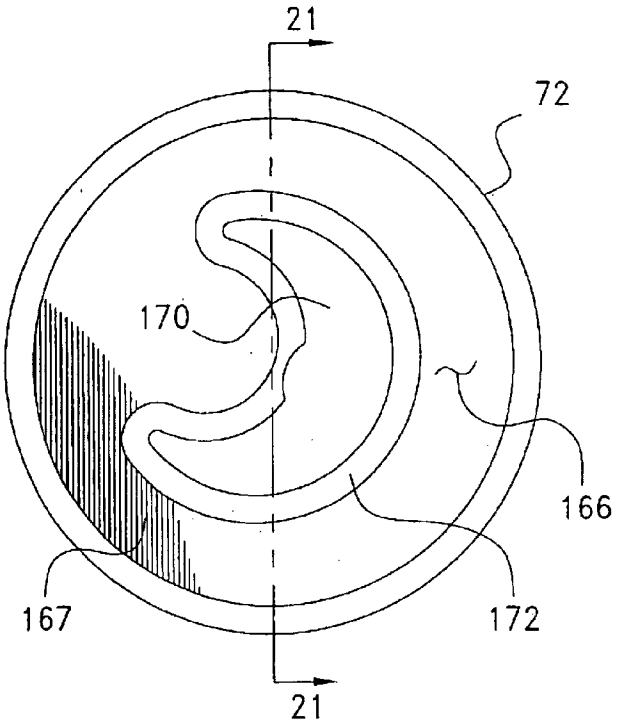
FIG. 19 is an upstream end view of the heat shield plate for the injector.

Referring now to FIGS. 19–21, the heat shield plate 72 also has a generally circular, thin, flat configuration, with an upstream surface 166 (FIG. 19) having a central recess 167; and a solid, continuous downstream surface 168 (FIG. 20). A crescent-shaped air passage 170, similar to air passage 144 in spin-orifice plate 70, also extends through the plate. The crescent-shaped opening 170 is bounded around its periphery by a raised wall 172, which seals against downstream surface 142 of the spin-orifice plate 70 so that the air passage is fluidly separated from the recess 167.

When the heat shield plate 72 is located in adjacent, surface-to-surface relation to spin-orifice plate 70, with the upstream surface 166 of the heat shield plate adjacent the downstream surface 142 of the spin-orifice plate, recess 167 in heat shield plate 72 creates a stagnant air gap between the heat shield plate and the spin-orifice plate to protect the downstream end of the injector from combustion temperatures.

The recesses, passages and openings in the plates of the fuel plate assembly are preferably formed by etching through thin sheets of etchable material, e.g., sheets of an appropriate metal. The etching is preferably a chemical or electrochemical etch, which allows these flow paths to have uniformly rounded edges with no burrs, which is conducive to efficient fluid flow. The swirl chamber defined between swirl chamber portions 134 in plate 68 (FIG. 15), and swirl chamber portion 148 in plate 70 (FIG. 18) preferably has a bowl shape, while the inlet fuel passages defined between passages 136 in plate 68 (FIG. 15) and channels 160 in plate 70 preferably have a trough shape with rounded walls. The trough shape of the fuel feed passages blends with the rounded walls of the swirl chamber to provide efficiency of fluid flow in the transition between the passages and the swirl chamber. Further discussion of chemically and electromechanically etching feed passages and swirl chambers in a thin metal sheet can be found in U.S. Pat. No. 5,435,884, which is incorporated herein by reference. Other conventional etching techniques, which should be known to those skilled in the art, are of course also possible.

Further, while a simplex nozzle is shown and described for providing a hollow conical atomized fuel spray, it should be appreciated that other nozzle designs such as air blast, etc., could alternatively (or in addition) be used with the present invention, and other spray geometries, such as plain jet, solid cone, flat spray, etc., could also be provided Also, while identical round spray are described for each of the spokes, it should be appreciated that the dimensions and geometries of the orifices may vary spoke-to-spoke, to tailor the fuel spray volume to a particular application. This can be easily accomplished by the aforementioned etching process. The number, length and other dimensions of the spokes may also vary depending upon the particular application. The spokes may also be angled (inwardly forward or outwardly away from the central axis) to further customize the fuel distribution for a particular application. This can easily be accomplished by bending the spokes during manufacture of the plate.

Figure 23:
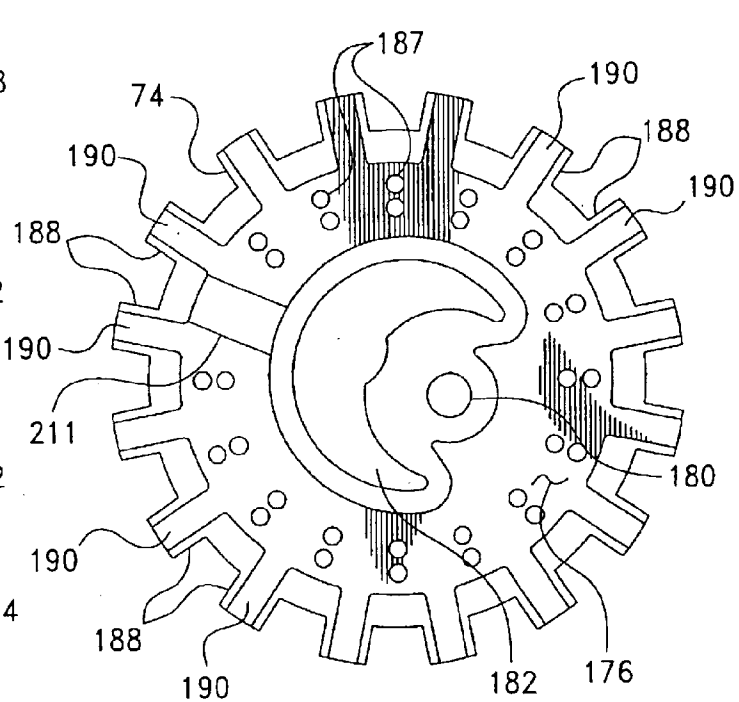
FIG. 23 is a downstream end view of the air distribution plate of FIG. 22.
Figure 24:
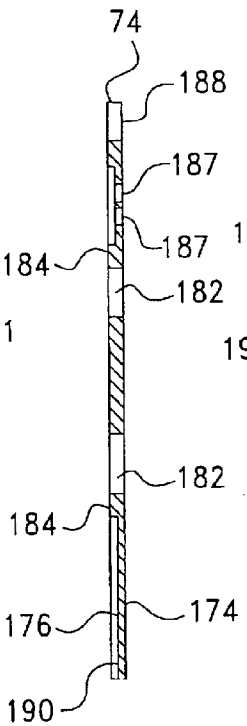
FIG. 24 is a cross-sectional side view of the air distribution plate of FIG. 22, taken substantially along the plane defined by the lines 24—24 in FIG. 22.
Figure 22:
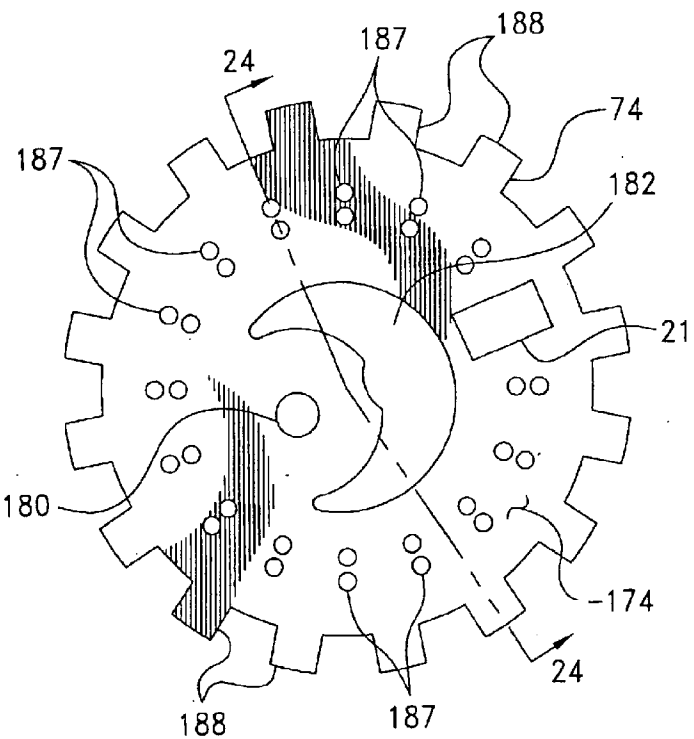
FIG. 22 is an upstream end view of one of the air distribution plates for the injector.

Referring now to FIGS. 22–24, the air distribution plate 74 of the cooling plate assembly is shown, and has a generally circular, thin, flat configuration. The upstream surface 174 (FIG. 22) is generally solid and continuous; while the downstream surface 176 (FIG. 23) has a central recess 178. A circular fuel opening 180 and a crescent-shaped air passage 182 similar to passage 94 in adjacent manifold plate 64, also extend through the plate. Fuel tube 51 is closely received in and passes through fuel opening 180. The crescent-shaped opening 182 is bounded around its periphery on the downstream surface 176 by a raised wall 184, which seals against the upstream surface 86 of manifold plate 64 so that the air passage is fluidly separated from the recess 178. A plurality of air openings, as at 187, are provided in evenly-spaced arrangement in one or more annular arrangements around the plate. The air openings are designed to evenly distribute air into the recess 178 between the main air distribution plate 74, and the manifold plate 64. The appropriate number, location and dimension of the openings can be easily determined by simple experimentation.

A plurality of spokes, as at 188, project radially outward from the central axis of the plate. A shallow channel as at 190, is formed in the downstream surface 176 along each spoke, leading from the central recess 178 to the distal end of each spoke, to direct air radially outward.

When the main air distribution plate 74 is located in adjacent, surface-to-surface relation to manifold plate 64, with the downstream surface 176 of the main air distribution plate adjacent the upstream surface 86 of the manifold plate, the spokes 188 of the main air distribution plate and the adjacent spokes 96 of the manifold plate are also located in opposing relation, with the channels 190 in main air distribution plate 74 directing air radially outward along the spokes 96 of the manifold plate. The air passes radially outward along the spokes 96 of the manifold plate to cool the upstream surface of this plate.

Figure 26:
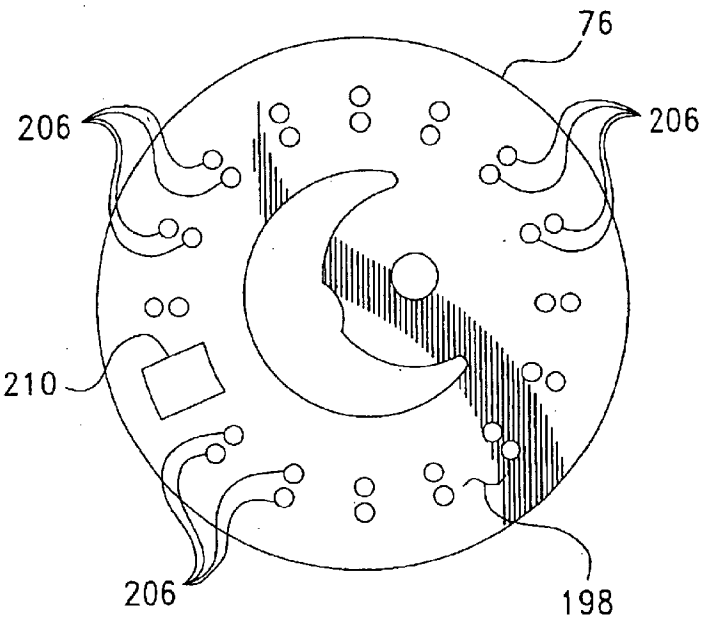
FIG. 26 is a downstream end view of the air distribution plate of FIG. 25.
Figure 27:
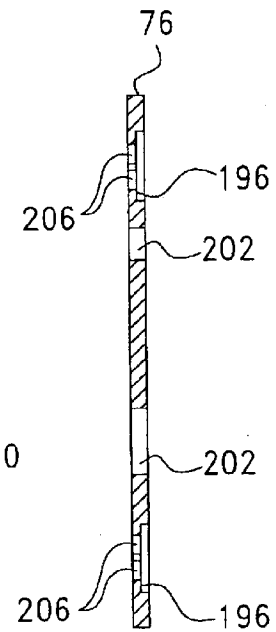
FIG. 27 is a cross-sectional side view of the air distribution plate of FIG. 26, taken substantially along the plane defined by the lines 27—27 in FIG. 25.
Figure 25:
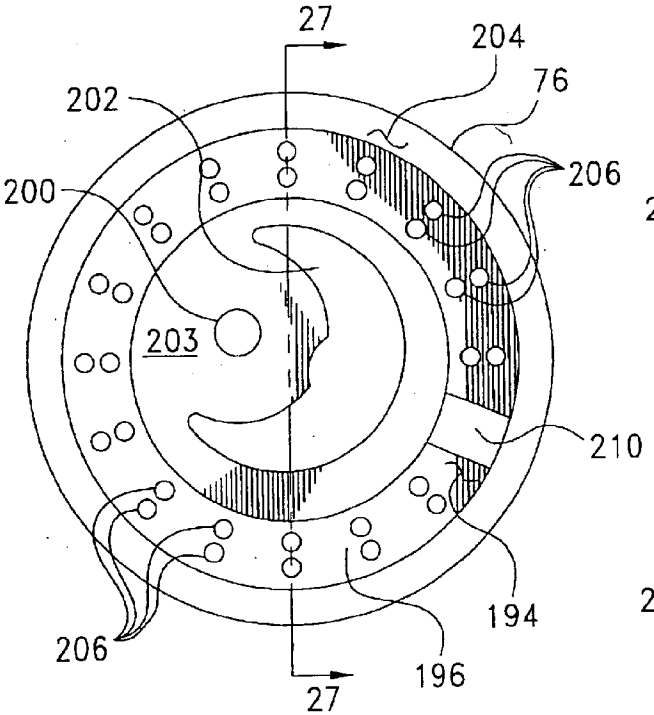
FIG. 25 is an upstream end view of the another of the air distribution plates for the injector.

Referring now to FIGS. 25–27, the equalizing plate 76 also has a generally circular, thin, flat configuration. The upstream surface 194 (FIG. 25) has an annular recess 196; while the downstream surface 198 is generally solid and continuous. A circular fuel opening 200 and a crescent-shaped air passage 202, similar to passage 182 in adjacent air distribution plate 74, also extend through the plate. Fuel tube 51 is closely received in and passes through fuel opening 200. The central surface area 203 of the plate surrounding the crescent-shaped opening 202 and the peripheral surface area 204 surrounding recess 196, seal against the upstream surface 174 of main air distribution plate 74. A plurality of air openings, as at 206, are provided in evenly-spaced arrangement in one or more annular arrangements around the recess 196. The air openings 206 are aligned with air openings 182 in adjacent air distribution plate 74, and are designed to evenly distribute air from annular recess 196 into openings 206. Again, the appropriate number, location and dimension of the openings can be easily determined by simple experimentation. Alignment opening 210 in plate 76 and opening 211 in plate 74 can be used during assembly to facilitate aligning equalizing plate 76 with air distribution plate 74.

Figure 28:
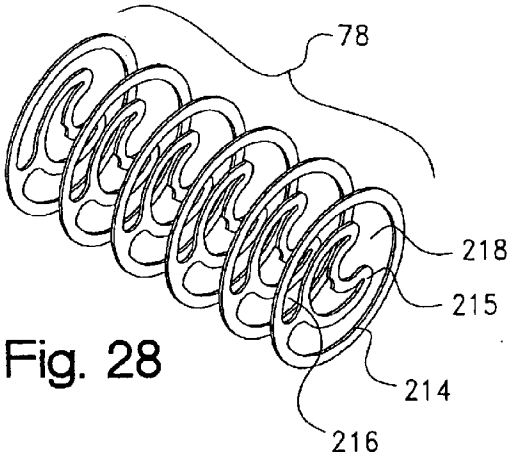
FIG. 28 is an exploded view of still other air distribution plates for the injector.

Referring now to FIG. 28, the air distribution plate stack 78 includes a series of preferably identical plates, each with generally circular, thin flat configurations. The plates each have an outer ring 214, and an inner frame 215 which bounds a crescent-shaped air passage 216, similar to passage 202 in adjacent equalizing plate 76, extending through each plate of the plate stack. A passage 218 is also defined between the outer ring 214 and the frame 215 in each plate, which generally corresponds to the annular recess 196 in the adjacent equalizer plate 76. Inner frame 215 is slightly spaced apart from and circumferentially surrounds a portion of fuel tube 51. The number of plates in plate stack 78 can vary.

Referring again to FIG. 5, the additional air inlet and distribution plates 80, 81 and 82, each also preferably have a generally circular, thin, flat configuration with solid and continuous upstream and downstream surfaces. Each plate also has a central opening 220; and a crescent-shaped opening 222 which are aligned with each other, and with the crescent-shaped openings in all the other plates. The air tube 52, which is coaxial with and outwardly surrounds the fuel tube 51, is closely received in the central openings 200 in plates 80–82, terminating at downstream plate 80.

When the plates 80–82 and plate stack 78 are assembled together in adjacent relation, the air tube 52 delivers air into the passage 218 in stack 78, where the air is then evenly distributed through openings 206 in equalizer plate 76, and openings 187 in main air distribution plate 74, enters recess 178, and is applied against the upstream surface of manifold plate 64. As described above, the air then passes outwardly along spokes 188 in air distribution plate 74, where the air assists in cooling the underlying spokes from the fuel plates. The air then passes downstream around the fuel sprays emanating from the spokes, to assist in fully atomizing the fuel, dispersing the fuel droplets, and thoroughly mixing the fuel with air.

It is noted that crescent-shaped passages are provided through all the plates of the injector. The passages are designed to direct a central air flow through the plate stack to assist in atomization of the fuel and cooling of the plate stack. The shape of the passages is largely directed by the application, and it should be apparent that some applications may not need such a central air passage.

Further, while it is preferred to have the cooling plate assembly upstream from the fuel plate stack, it is possible that some applications will only require a fuel plate stack, and cooling will be performed by other means rather than a cooling plate stack.

The passages and openings in the plates of the cooling plate assembly 58 are also preferably formed by chemical or electromechanical etching, where appropriate.

The plates of the fuel plate assembly 56 and of the cooling plate assembly 58 are all fixed together, such as by diffusion bonding in a high temperature furnace under a vacuum; by high-temperature brazing; or by some other appropriate technique, which should be known to those skilled in the art.

Thus, as described above, the present invention provides an injector, particularly useful for dispensing liquid fuel in gas turbine applications, which is an improvement over the previous designs. The injector has multiple nozzles for improved fuel delivery, and has a compact form, which reduces the size and weight of the engine, and good thermal management. The injector preferably has passages which are formed by chemical etching, so that the fluid efficiently flows through the injector. The actively cooled nozzle provides good atomization performance, fast droplet dispersion and good fuel-air mixture homogeneity.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. An injector for a gas turbine engine, the injector comprising:

a pair of fuel plates having inner surfaces disposed in adjacent surface-to-surface relation, and defining a fuel cavity therebetween, with one of the fuel plates having an inlet opening to receive fuel, and the other of the fuel plates having at least one outlet opening for dispensing fuel;

a fuel tube for directing fuel through the inlet opening and into the fuel cavity, where the fuel then passes through the at least one outlet opening; and a cooling plate disposed in adjacent, surface-to-surface relation with one of the fuel plates, and defining a fluid passage therebetween with the cooling plate having an opening for receiving cooling fluid, wherein the fuel plates and cooling plate are all flat plates, located in co-planar relation to one another.

2. The injector as in claim 1, wherein the fuel plate with the inlet opening is located upstream of the fuel plate with the outlet opening, and the cooling plate is located adjacent the upstream fuel plate, and the fuel tube passes through an opening in the cooling plate, through the fluid passage, and is received in an opening in the upstream fuel plate.

3. The injector as in claim 1, wherein the fuel tube extends along a central axis of the fuel plates, substantially perpendicular to the plates, and further including an air tube concentrically disposed with the fuel tube, directing air into the fluid passage between the cooling plate and the one fuel plate.

4. The injector as in claim 3, wherein the air tube surrounds the fuel tube.

5. The injector as in claim 1, wherein the fuel plates and the cooling plate are all thin flat plates.

6. The injector as in claim 5, wherein the fuel plates and the cooling plate are circular.

7. An injector for a gas turbine engine, the injector comprising:

a pair of fuel plates having inner surfaces disposed in adjacent surface-to-surface relation, and defining a fuel cavity therebetween, with an upstream one of the fuel plates having an inlet opening to receive fuel, and a downstream one of the fuel plates having at least one outlet opening for dispensing fuel;

a fuel tube for directing fuel through the inlet opening and into the fuel cavity, where the fuel then passes through the at least one outlet opening; and a cooling plate disposed in adjacent, surface-to-surface relation with one of the fuel plates, and defining a fluid passage therebetween with the cooling plate having an opening for receiving cooling fluid, and further including a plurality of outlet openings in the downstream fuel plate, and wherein separate fuel feed passages lead from the fuel cavity to the outlet openings.

8. The injector as in claim 7, wherein the fuel plates each have radial spokes projecting outwardly from a central axis of the plates, with a spoke from one fuel plate located in adjacent opposing relation to a spoke from the other fuel plate, and a fuel passage is defined between each of the adjacent opposing spokes fluidly connected at one end to the fuel cavity and at another end to a dispensing opening in the downstream fuel plate toward the distal end of each of the spokes.

9. The injector as in claim 8, wherein the cooling plate is located adjacent the upstream fuel plate, and the cooling plate includes an opening receiving the fuel tube.

10. The injector as in claim 8, wherein the cooling plate includes spokes projecting radially outward from a central axis of the cooling plate, each of the spokes of the cooling plate being located adjacent a spoke from the upstream fuel plate, and defining therebetween an air passage from the fluid passage for directing air along the upstream surface of the fuel plate spoke.

11. An injector for a gas turbine engine, the injector comprising:

pair of fuel plates having inner surfaces disposed in adjacent surface-to-surface relation, and defining a fuel cavity therebetween, with an upstream one of the fuel plates having an inlet opening to receive fuel, and a downstream one of the fuel plates having at least one outlet opening for dispensing fuel;

a fuel tube for directing fuel through the inlet opening and into the fuel cavity, where the fuel then passes through the at least one outlet opening; and a cooling plate disposed in adjacent, surface-to-surface relation with one of the fuel plates, and defining a fluid passage therebetween with the cooling plate having an opening for receiving cooling fluid, and further including a cooling plate stack located upstream from the fuel plates, wherein the cooling plate stack including a main air distribution plate having a downstream surface located adjacent an upstream surface of the upstream fuel plate; a second air distribution plate having a downstream surface located adjacent an upstream surface of the first air distribution plate.

12. An injector for a gas turbine engine, the injector comprising:

a pair of fuel plates having inner surfaces disposed in adjacent surface-to-surface relation, and defining a fuel cavity therebetween, with an upstream one of the fuel plates having an inlet opening to receive fuel, and a downstream one of the fuel plates having at least one outlet opening for dispensing fuel;

a fuel tube for directing fuel through the inlet opening and into the fuel cavity, where the fuel then passes through the at least one outlet opening; and a cooling plate disposed in adjacent, surface-to-surface relation with one of the fuel plates, and defining a fluid passage therebetween with the cooling plate having an opening for receiving cooling fluid, and further including concentric fuel and air tubes directing fuel and air to the injector, with the fuel tube passing through the cooling plate and terminating at the upstream fuel plate, and the air tube terminating at the cooling plate.

13. An injector for a gas turbine engine, the injector comprising:

a pair of fuel plates having inner surfaces disposed in adjacent surface-to-surface relation, and defining a fuel cavity therebetween, with an upstream one of the fuel plates having an inlet opening to receive fuel, and a downstream one of the fuel plates having at least one outlet opening for dispensing fuel;

a fuel tube for directing fuel through the inlet opening and into the fuel cavity, where the fuel then passes through the at least one outlet opening; and a cooling plate disposed in adjacent, surface-to-surface relation with one of the fuel plates, and defining a fluid passage therebetween with the cooling plate having an opening for receiving cooling fluid, and further including an additional plate located in surface-to-surface contact with the downstream fuel plate, and having a swirl chamber located in adjacent relation to each dispensing opening providing fuel received from the dispensing opening with a swirl component of motion.

* * * * *

UNITED STATES PATENT AND TRADEMARK OFFICE

CERTIFICATE OF CORRECTION

PATENT NO. : 6,763,663 B2
DATED : January 6, 2004
INVENTOR(S) : Zhiqiang Wu et al.

It is certified that error appears in the above-identified patent and that said Letters Patent is hereby corrected as shown below:

Column 2,
Line 48, replace "which is different 14 from the first conductivity type is" with -- which is different from the first conductivity type is --

Column 3,
Line 59, replace "provided through multiple doping 11 steps and comprises a" with -- provided through multiple doping steps and comprises a --

Column 4,
Line 47, replace "In the illustrated 11 example, third dopant 48 defines" with -- In the illustrated example, third dopant 48 defines --
Line 49, replace "which can be different from first and 13 second" with -- which can be different from first and second --

Column 5,
Line 46, replace "compensation effect in which p- ADD regions 66, 68 and" with -- compensation effect in which p- LDD regions 66, 68 and --

Signed and Sealed this

Seventeenth Day of August, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,763,663 B2
DATED : July 20, 2004
INVENTOR(S) : Adel B. Mansour et al.

It is certified that error appears in the above-identified patent and that said Letters Patent is hereby corrected as shown below:

This certificate supersedes Certificate of Correction issued August 17, 2004, the number was erroneously mentioned and should be vacated since no Certificate of Correction was granted.

Signed and Sealed this

Twenty-eighth Day of September, 2004

JON W. DUDAS
*Director of the United States Patent and Trademark Office*

UNITED STATES PATENT AND TRADEMARK OFFICE

CERTIFICATE OF CORRECTION

PATENT NO. : 6,763,663 B2
DATED : January 6, 2004
INVENTOR(S) : Zhiqiang Wu et al.

It is certified that error appears in the above-identified patent and that said Letters Patent is hereby corrected as shown below:

Column 2,
Line 48, replace "which is different 14 from the first conductivity type is" with
-- which is different from the first conductivity type is --

Column 3,
Line 59, replace "provided through multiple doping 11 steps and comprises a" with
-- provided through multiple doping steps and comprises a --

Column 4,
Line 47, replace "In the illustrated 11 example, third dopant 48 defines" with
-- In the illustrated example, third dopant 48 defines --
Line 49, replace "which can be different from first and 13 second" with -- which can be different from first and second --

Column 5,
Line 6, replace "compensation effect in which p- ADD regions 66, 68 and" with
-- compensation effect in which p- LDD regions 66, 68 and --

Signed and Sealed this

Ninth Day of November, 2004

JON W. DUDAS
*Director of the United States Patent and Trademark Office*

UNITED STATES PATENT AND TRADEMARK OFFICE

CERTIFICATE OF CORRECTION

PATENT NO. : 6,763,663 B2
APPLICATION NO. : 10/120288
DATED : July 20, 2004
INVENTOR(S) : Adel B. Mansour et al.

It is certified that error appears in the above-identified patent and that said Letters Patent is hereby corrected as shown below:

This certificate supersedes the Certificate of Correction issued November 9, 2004, the number was erroneously mentioned and should be vacated since no Certificate of Correction was granted.

Signed and Sealed this

Twentieth Day of May, 2008

JON W. DUDAS
*Director of the United States Patent and Trademark Office*